United States Patent [19]

Fisk et al.

[11] 4,091,353

[45] May 23, 1978

[54] CURRENT LIMITING FUSE

[75] Inventors: Robert W. Fisk, Cape Elizabeth, Me.; Michael H. McLaughlin, Scotia, N.Y.

[73] Assignee: General Electric Company, Schenectady, N.Y.

[21] Appl. No.: 782,934

[22] Filed: Mar. 30, 1977

[51] Int. Cl.[2] ..... H01H 85/02

[52] U.S. Cl. ..... 337/204; 337/273; 337/277

[58] Field of Search ..... 337/204, 277, 276, 280, 337/273, 166, 282, 158

[56] References Cited

U.S. PATENT DOCUMENTS

| | | | |
|---|---|---|---|
| 3,710,295 | 1/1973 | Staub et al. | 337/166 |
| 3,851,290 | 11/1974 | Stover et al. | 337/166 |
| 4,041,434 | 8/1977 | Jacobs, Jr. et al. | 337/204 |
| 4,058,785 | 11/1977 | Frind et al. | 337/204 |

*Primary Examiner*—Harold Broome

*Attorney, Agent, or Firm*—P. R. Webb, II; J. T. Cohen; M. Snyder

[57] ABSTRACT

A current limiting fuse is disclosed wherein at least one fuse element is positioned within and extends from a sealed electrically insulating glass member substantially filled with dielectric liquid. The glass member is positioned within an outer casing having electrical terminals and filled with granular material. The fuse element extends to the electrical terminals. The narrow space filled substantially with dielectric liquid defines the arc constrictor while the outer casing defines the plasma cooler space.

6 Claims, 3 Drawing Figures

CURRENT LIMITING FUSE

The present invention relates in general to fuses and more particularly to fuses which will carry high normal currents and yet will provide rapid circuit interruption for undesirably high currents of short duration.

Such large current, high speed fuses are presently available for the protection of devices such as high current carrying semiconductor control devices. Such prior art fuses include fusible elements such as small wires or ribbon, enclosed in a housing containing a gas. The fusible elements are usually embedded in a solid-granular material such as sand or ceramic. While such fuses will melt and interrupt a circuit when large currents of short duration, for example several milliseconds, are passed therethrough, at lower currents of longer time duration excessive element temperature cycling usually results in failure at less than the design failure value.

In U.S. Pat. No. 3,710,295, a current limiting fuse is described wherein at least one fusible conductive element is connected between a pair of electrodes. Portions of the electrodes and the element are positioned within a housing filled with a dielectric liquid. This patent is assigned to the same assignee as the present application.

In U.S. Pat. No. 3,851,290, a fuse is described wherein the length of the fuse is supported by a link holder within a housing filled with dielectric liquid.

In copending patent application Ser. No. 725,380, filed Sept. 22, 1976, there is described a current limiting fuse wherein at least one fuse element is employed and each such fuse element is positioned in a narrow space filled with dielectric liquid adjacent a rigid electrically insulating member with a plurality of rupturable vents and a chamber on the opposite side of the member.

The present invention is directed to an improved current limiting fuse wherein a fuse element is positioned within and extends from a sealed electrically insulating glass member substantially filled with dielectric liquid. The glass member is positioned within an outer casing having electrical terminals and filled with granular material.

It is an object of the present invention to provide a fuse with high normal current capacity yet which provides rapid circuit interruption for undesirably high currents of short time duration.

It is another object of the present invention to provide a current limiting fuse of large current carrying capacity yet which is more rapid in response to overload currents.

It is another object of the present invention to provide a current limiting fuse which is easily assembled and assembled at a lower cost.

It is a further object of the present invention to provide a fuse of smaller size than conventional fuses for a given current rating.

In accordance with one aspect of our invention, a current limiting device employs a fuse element positioned within and extending from a sealed glass member filled with dielectric liquid. The glass member is positioned within an outer casing having electrical terminals and filled with granular material. The fuse element extends to the electrical terminals.

These and various other objects, features and advantages of the invention will be better understood from the following description taken in connection with the accompanying drawings in which.

Figure 1:
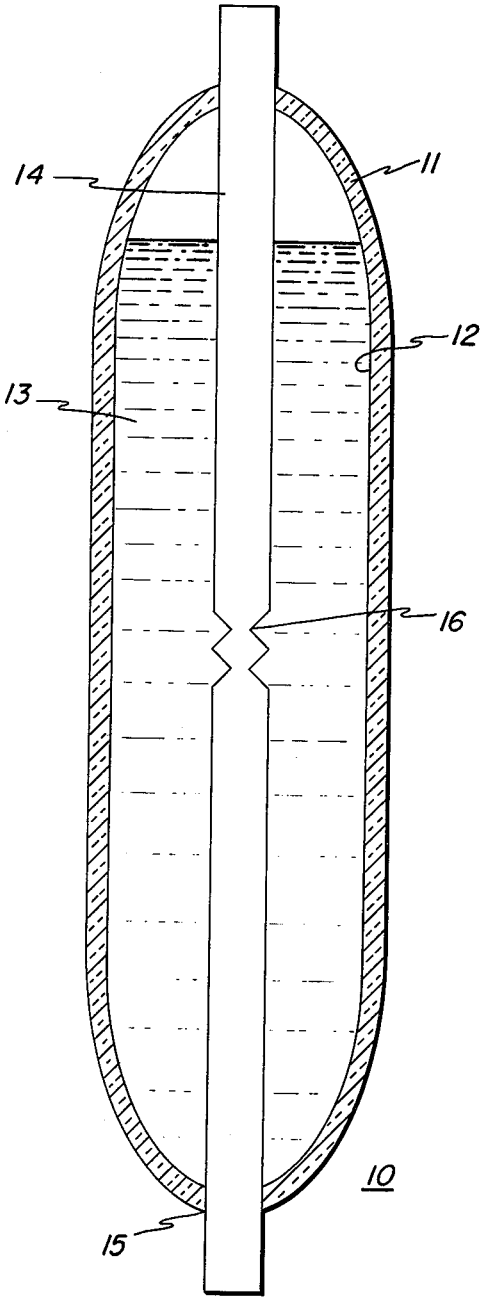
FIG. 1 is a sectional view of a fuse element.

In FIG. 1 of the drawing, there is shown a glass enclosed fuse element 10 which comprises an electrically insulating glass member 11 defining a narrow space 12 therein forming an arc constrictor. A dielectric liquid 13 substantially fills narrow space 12 of member 11. A fuse element 14 extends longitudinally through space 12 in member 11 and outwardly therefrom. Member 11 has opposite closed ends 15 which are shown as sealed directly to fuse element 14. A typical reduced cross-section 16 is shown approximately equal distance from the opposite closed ends 15. Fuse element 14 is immersed substantially in dielectric liquid 13. The resulting device is a single glass enclosed fuse element.

Figure 2:
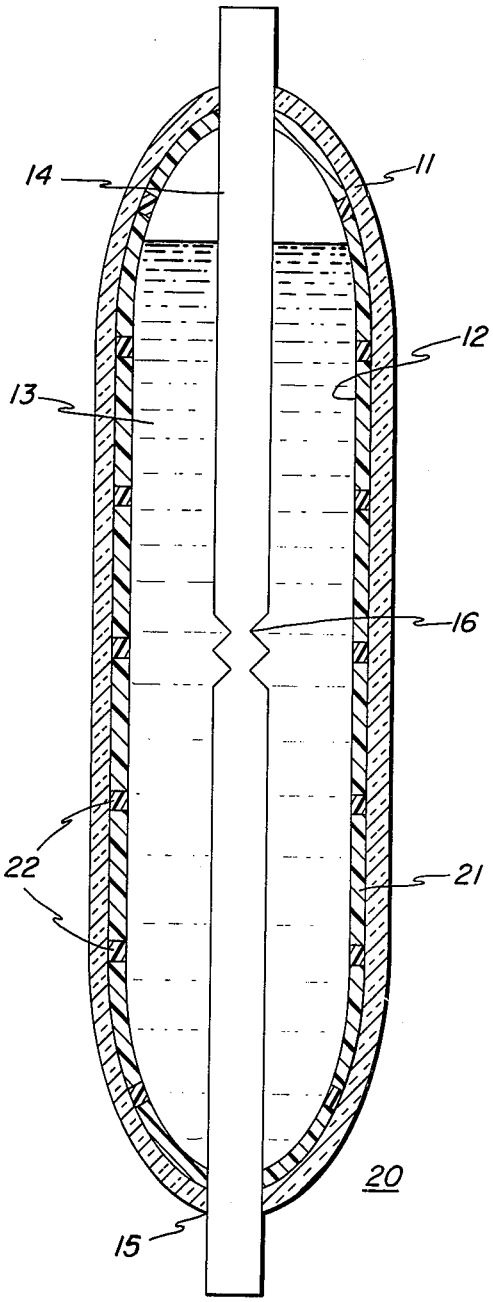
FIG. 2 is a sectional view of a modified fuse element.

In FIG. 2 of the drawing, there is shown a modified glass enclosed fuse element 20 which is identified by similar numbers as appear in FIG. 1 of the drawing. Electrically insulating glass member 11 defines similarly a narrow space 12 filled substantially with a dielectric liquid 13. Fuse element 14 with a typical reduced cross-section 16 is immersed in dielectric liquid 13 and extends longitudinally through member 12 and outwardly therefrom. Within electrically insulating glass member 11 there is provided a rigid electrical insulating member 21 having a plurality of rupturable vents 22. Member 21 is of the same configuration as glass member 11 and fits within glass member 11 adjacent to the glass member.

Figure 3:
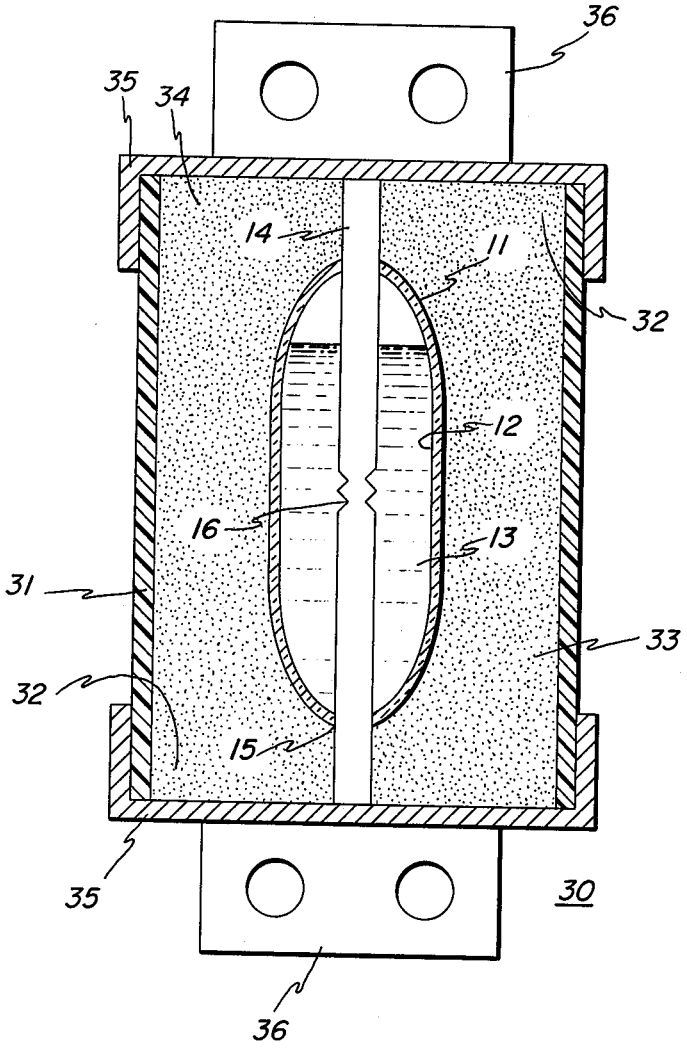
FIG. 3 is a sectional view of a current limiting fuse made in accordance with our invention.

In FIG. 3 of the drawing, there is shown a current limiting fuse 30 made in accordance with our invention. Fuse 30 is shown containing a single glass enclosed fuse element 10 of the type described above for FIG. 1. It can, of course, be appreciated that glass enclosed fuse element 20, from FIG. 2 of the drawing, can also be employed in FIG. 3. Further, a plurality of glass enclosed fuse elements 10 or 20 can be enclosed within fuse 30 for higher current ratings.

Fuse 30 is shown with one electrically insulating glass member 11 defining a narrow space 12 therein forming an arc constrictor. Dielectric liquid 13 fills substantially narrow space 12. Member 11 has opposite closed ends 15 and a fuse element 14 substantially immersed in dielectric liquid 13. Fuse element 14 with a typical reduced cross-section 16 extends longitudinally through member 11 and outwardly therefrom. An outer casing 31 has opposite open ends 32 surrounding member 11 and spaced therefrom defining a plasma cooler space 33. Granular material 34, such as sand, fills plasma cooler space 33 and surrounds member 11 and outwardly extending portions of fuse element 14. A pair of metallic end caps 35 with associated electrical terminals 36 are provided. Casing 31 has opposite open ends 32 fitted directly within metallic end caps 35 and associated electrical terminals 36. Casing 31 is insulated electrically from at least one of the electrical terminals. Each opposite end of fuse element 14 is an electrical connection with its associated electrical terminals 36. An electrically insulating liner within outer casing 31 might be required for some configurations with a conducting wall.

We found that we could house the individual current carrying or fuse element inside a glass enclosure that ruptures upon current interruption. The fabrication and assembly of the outer fuse casing will then be similar to present silver-sand methods. Conventional glass to metal sealing techniques are used. We found that we could form the individual fuse element by providing an electrically insulating glass member which defines a narrow space therein forming an arc constrictor. A dielectric liquid fills substantially the narrow space. A fuse element is immersed in the dielectric liquid and extends longitudinally through the member and outwardly therefrom. The glass member has opposite closed ends which are sealed directly to the fuse element by conventional metal to glass sealing methods. It will be appreciated that low temperature sealing glass covers could be sealed to the opposite ends of the glass member. The fuse element would extend through an opening in each cover which would be sealed by conventional metal to glass sealing methods.

Silver-sand construction is now the standard for the current limiting fuse. Because of the heat transfer characteristics inside the fuse case, the silver-sand fuse cannot be designed to maximize the steady state rating of a thyristor or motor without sacrificing some transient surge rating. Temperatures in excess of 400° C in the silver element during thermal overload also promote thermal fatigue which leads to premature failure.

Initial designs of boiling fuses ignored the problems of arc interruption and were unacceptable for medium and high voltage operation (>200V.). An improved design of this type of fuse incorporated both an arc constrictor and plasma cooler is set forth in above-identified copending patent application Ser. No. 725,380 now U.S. Pat. No. 4,058,785. Initial tests of improved design demonstrated feasibility of the concept for current carrying capability and voltage interruption. The design of this fuse incorporated many techniques not presently used in the manufacture of silver-sand fuses. Furthermore, the case of the fuse had to be significantly stronger in order to contain the high pressures generated during interruption.

The present invention is an improved design over the above-discussed patents, over the above identified copending patent application Ser. No. 725,380 now U.S. Pat. No. 4,058,785 and previous silver-sand fuses in that the individual fuse element is contained within a sealed glass member which ruptures upon current interruption. Further, the fabrication of present fuse is simple and minimizes high pressure seals.

The fuse element of the present invention is sealed within an electrically insulating glass member or tube of approximately the same internal diameter as the width of the fuse element. For example, this member can be composed of a solder glass where excellent metal-to-glass seals are useable in the temperature range from 450°–600° C. The melting temperature of silver is 960° C. Several of these single element members can be sealed in a single outer case to obtain high current ratings.

The current carrying fuse element should have its typical reduced cross-section in the center away from the opposite ends of the glass member so as to prevent the possibility of having the cross-section exposed to vapor and not liquid. Heat generated in the section of the element not covered by liquid is small and can be conducted to the liquid/vapor interface and to the glass seal without significant temperature rise ($<<100°$ C).

The glass member is nearly filled with dielectric liquid during normal operation. This permits use of the fuse in both a horizontal and vertical orientation, a very desirable characteristic. The dielectric working liquid can most easily be introduced through a small fill tube located at any position on the tube. After the proper amount of liquid is introduced, a simple glass fusing is used to seal the glass member.

The sealed member or tube with element is placed inside a sand-filled outer fuse casing. The sand surrounding the glass member conducts heat from the member to the casing during steady-state and overload operation. The present current limiting fuse eliminates about 67 percent of the heat conduction thermal resistance through the sand. Working liquid temperatures are about 100° C during typical operating conditions. Depending on interruption characteristics, a perforated, electrical insulating sleeve modification is employed within the glass member. The purpose of this sleeve is to contain the arc during interruption while permitting the products formed during interruption to be expelled out the sides and ends. The surrounding sand acts as both the plasma cooler and expansion volume because of its high surface area and interstitial volume. Pressure during and after interruption is minimized since the sand particles provide a uniform flow path for escaping gas, heat transfer rates to the sand particles are quite high due to the high surface area, the quantity of working liquid present inside the case has been minimized, and because of the increase in the gas expansion volume within the sand.

Other degrees of arc confinement time and arc quenching rate are achieved by shaping the glass member designing pressure burst segments while maintaining general integrity of glass member for confinement, and designing a pressure pulse break pattern into the glass for maximum arc confinement with high fluid exit rates. The present fuse design offers another cost advantage. By dimpling the glass member, small knobs can be made to project into the liquid space and these center the fuse element in the channel. This technique may be desirable with high voltage fuses because of the long (>10 inch) elements that are required.

The above-described fuse element sealed within a glass member with dielectric liquid therein and portions of the fuse element extending from opposite ends of the glass member is positioned within an outer casing. The outer casing having opposite open ends surrounding the member and spaced therefrom defines a plasma cooler space which is filled with granular material. A pair of metallic end caps with associated electrical terminals are fitted tightly on opposite ends of the casing. The casing is insulated electrically from at least one of the electrical terminals. Each opposite end of the fuse element is in electrical connection with its associated electrical terminal. An electrically insulating liner might be required within the outer casing for some configurations. The device results in a current limiting fuse element made in accordance with our invention. Each opposite end of the fuse element is in electrical contact with the electrical terminals through the associated end caps. Electrical terminals are connected electrically to each of the end caps by being affixed thereto or integral therewith. It will be appreciated that direct electrical contact can be accomplished between the fuse element and its associated electrical terminals. For example, the fuse element can contact directly at each opposite end the respective electrical terminal. Such a configuration can include a pair of metallic end caps, each of which has a center opening. An electrical terminal has its base positioned within the opening in the end cap. An electrically insulating ring positions the base of the electrical terminal within the opening of the end ring and bonds the structure thereby providing a closed end for the fuse.

In a second configuration of the current limiting fuse, the glass member has positioned therein and adjacent its inner surface a rigid electrically insulating member having a plurality of rupturable vents. The rigid electrically insulating member is suitably formed of a plastic or ceramic material while the outer casing of both configurations is suitably formed of an electrically insulating high strength material. The rigid electrically insulating member having a plurality of rupturable vents can alternately be positioned adjacent the exterior surface of the glass member. A metal outer casing can also be employed but a non-conducting liner may be required and the casing must be electrically insulated from at least one of the end caps. The rupturable vents of the rigid electrically insulating member should rupture between 5 to 10 atmospheres of pressure. Such rupturable vents include a variety of configurations such as vents in a ceramic membrane covered with a plastic membrane or thinner portions in the member to provide the vents. The electrical arc, which is generated after the fuse element vaporizes is well confined within such narrow space and exhibits high voltage gradients of the order of 200 volts per centimeter. The arc voltage shows, on account of the good arc control, only moderate fluctuations.

Cold start-up rating is a requirement affecting design of the current limiting fuse. Since the maximum nucleate boiling heat flux declines with decreasing temperature of the liquid within the temperature range of interest, it is desirable to minimize fuse derating. This can be accomplished by the addition of an inert, non-condensable gas, such as nitrogen to the sealed glass member.

In carrying out the invention, and as applied particularly to the embodiments shown in the drawing and described above, a first predetermined current flow in the fuse element produces a first predetermined thermal power flow into the liquid which is sufficient to produce nucleate boiling of the liquid. A second greater predetermined current flow in the fuse elements produces a second predetermine thermal power flow into the liquid which is sufficient to produce vapor film boiling in the liquid. Since the heat transfer coefficient for the nucleate boiling regime is substantially greater than the heat transfer coefficient for the vapor film boiling regime, thermal energy accumulates in the fuse element at a rapid rate and raises the temperature at a rapid rate. The fuse element is constituted of a material and designed so that the second predetermined current raises the temperature thereof above the melting point of the elements. In view of the low thermal mass of the fuse element, such temperature rise is rapid. Accordingly, the element melts, arcing begins, the glass ruptures and rapidly the current is interrupted at the second predetermined value flowing through the fuse.

Our improved current limiting fuse will function in either a vertical or a horizontal position. A plurality of fuse elements in sealed glass members can be employed within a single outer casing. Further, an inert, non-condensable gas can be contained in the sealed glass member. Similarly, the fuse element can have one or more restrictions in cross-section.

The pre-arcing performance of the current limiting fuse is governed by the choice of dielectric liquid and by the fuse element which is the current carrying member. Each element is designed to carry a stated steady state current and also all specified long time overloads without failure or fatigue. Secondly, the fuse element must melt and clear under maximum available short circuit current in time to protect other equipment in the circuit. Thirdly, the shape of the interruption curve in the intermediate fault range, which is from 5 milliseconds to 1 second can be changed by element design to better match the fuse to the electric system it protects.

The fuse element design includes both the material and the geometry of the conductor. The choice of the fuse element material, such as, for example: tin, copper or silver, determines the relative surge performance with respect to the design steady state rating for a given width of fuse element. After the fuse element material has been chosen, the steady state and surge characteristics of the current limiting fuse can be tailored to the specific application requirements by variations in width, thickness, and restriction of cross-section. The geometry of the restriction and the restriction fraction are the most important variations in the tailoring of the shape in the interruption curve. The characteristics of arcs in narrow channels determines the number of restrictions required for interruption.

The present current limiting fuse can be employed to better protect semiconductor components, such as thyristors, against damaging short circuit current. The value of the clearing $I^2t$ of the current limiting fuse must be lower than the short time $I^2t$ capability of the semiconductor component. Tests have shown that current limiting fuses of the types embodied in our present invention will have from 6 to 12 times less $I^2t$ to melt than comparably current rated sand fuses under fault conditions. This improvement provides the protection needed to use semiconductor components near the maximum steady state current capability. Presently, the limitations of the ability of sand fuses to protect thyristors from short circuit faults necessitates the derating of the entire system with the use of lower current rated fuses.

In motor start applications, a current limiting fuse of the type embodied in our invention and a circuit breaker can be employed to protect the motor from harmful overloads and short circuit surges. The unacceptable overload ranges are controlled by the circuit breaker while the fuse clears all short circuit faults. As an example, a 100 amp drive with 5 times 30 second overload would require a circuit breaker to clear currents between 500 amps and 1000 amps. The fuse must be rated at least 500 amps continuous duty. Because the time to melt characteristic curve of the boiling fuse is so steep, an element can be designed to interrupt the 1000 amp current in less than 0.1 seconds. This capability leads to the use of a less expensive circuit breaker and significant cost reductions.

While other modifications of the invention and variations thereof which may be employed within the scope of the invention have not been described, the invention is intended to include such as may be embraced within the following claims.

What we claim as new and desire to secure by Letters Patent of the United States is:

1. A current limiting fuse comprising an electrically insulating glass member defining a narrow space therein forming an arc constrictor, a dielectric liquid substantially filling the narrow space, the glass member having opposite closed ends, a fuse element immersed in the dielectric liquid, the fuse element extending longitudinally through the member and outwardly through the opposite closed ends, an outer casing having opposite open ends surrounding the member and spaced therefrom defining a plasma cooler space, granular material filling the plasma cooler space and surrounding the member and portions of the fuse element, a pair of metallic end caps with associated electrical terminals, the casing having opposite open ends fitted tightly within the metallic end caps and associated electrical terminals, the casing insulated electrically from at least one of the electrical terminals, and each opposite end of the fuse element in electrical connection with its associated electrical terminal.

2. A current limiting fuse as in claim 1, in which a plurality of glass members are positioned spaced apart within the outer casing.

3. A current limiting fuse comprising an electrically insulating glass member defining a narrow space therein forming an arc constrictor, a rigid electrically insulating member having a plurality of rupturable vents positioned adjacent the glass member, a dielectric liquid substantially filling the narrow space, the glass member having opposite closed ends, a fuse element immersed in the dielectric liquid, the fuse element extending longitudinally through the member and outwardly through the opposite closed ends, an outer casing having opposite open ends surrounding the member and spaced therefrom defining a plasma cooler space, granular material filling the plasma cooler space and surrounding the member and portions of the fuse element, a pair of metallic end caps with associated electrical terminals, the casing having opposite open ends fitted tightly within the metallic end caps and associated electrical terminals, the casing insulated electrically from at least one of the electrical terminals, and each opposite end of the fuse element in electrical connection with its associated electrical terminal.

4. A current limiting fuse as in claim 3, in which a plurality of glass members are positioned spaced apart within the outer casing.

5. A current limiting fuse as in claim 3, in which the rigid electrically insulating member is positioned within the glass member.

6. A current limiting fuse as in claim 3, in which the rigid electrically insulating member is positioned outside the glass member.

* * * * *